US005123749A

United States Patent [19]

Avery, Jr.

[11] Patent Number: 5,123,749

[45] Date of Patent: Jun. 23, 1992

[54] BLENDER FOR PARTICULATE MATERIALS

[76] Inventor: Hugh E. Avery, Jr., 3764 Lake Dr., Houston, Tex. 77098

[21] Appl. No.: 683,320

[22] Filed: Apr. 10, 1991

[51] Int. Cl.[5] ..... B01F 5/24; B01F 13/00

[52] U.S. Cl. ..... 366/341

[58] Field of Search ..... 366/341, 101, 106, 107, 366/9, 10, 136, 137, 336

[56] References Cited

U.S. PATENT DOCUMENTS 4,285,602 8/1981 Hagerty ..... 366/341

4,353,652 10/1982 Young ..... 366/341

*Primary Examiner*—Robert W. Jenkins

*Attorney, Agent, or Firm*—Ezra L. Schacht

[57] ABSTRACT

A blending apparatus, inexpensive in construction and requiring a minimum of recirculation, is today essential for economical and thorough blending of particulate material, for example, plastic pellets of virgin material and of pellets that have been reconstituted from recycled material. Construction of the blender is low in cost because the customary receiver, and its piping, conventionally installed below the blender are eliminated. The novel convex baffle serves: (1) as a termination surface for the otherwise conventional perforated blending conduits; and (2) retains a toroidal annular volume of a specific particulate material as determined by an analogous test apparatus in position between the upper outer surface of the baffle and the inside wall of the blender. The final portion of the main stream of particulate material passes through the blending tubes, drops into the blending area below the convex baffle, whereupon the predetermined and pre-positioned amount of particulate material in the toroidal "keystone joist" is released to proportionally blend with it.

3 Claims, 7 Drawing Sheets

FIG.3
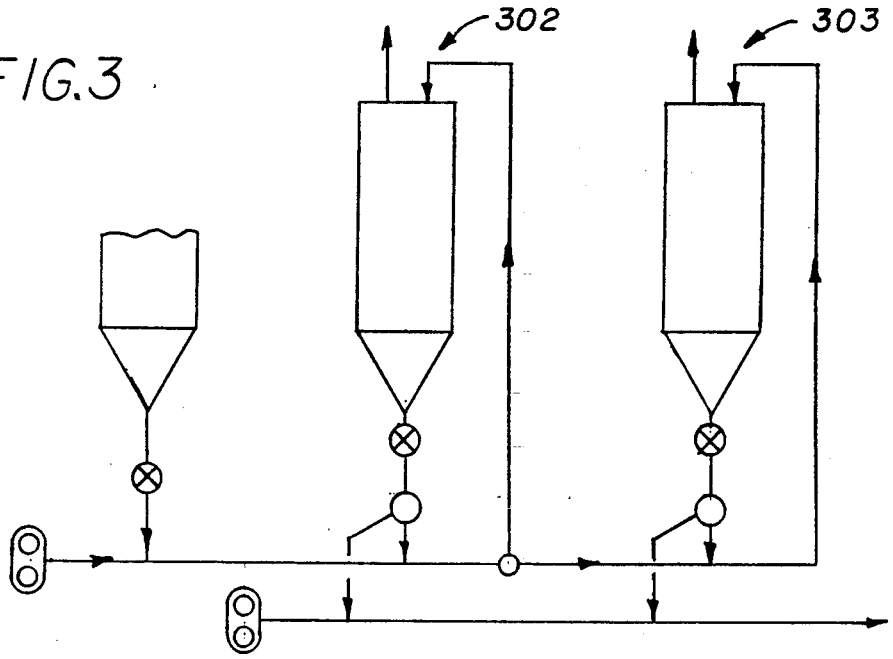
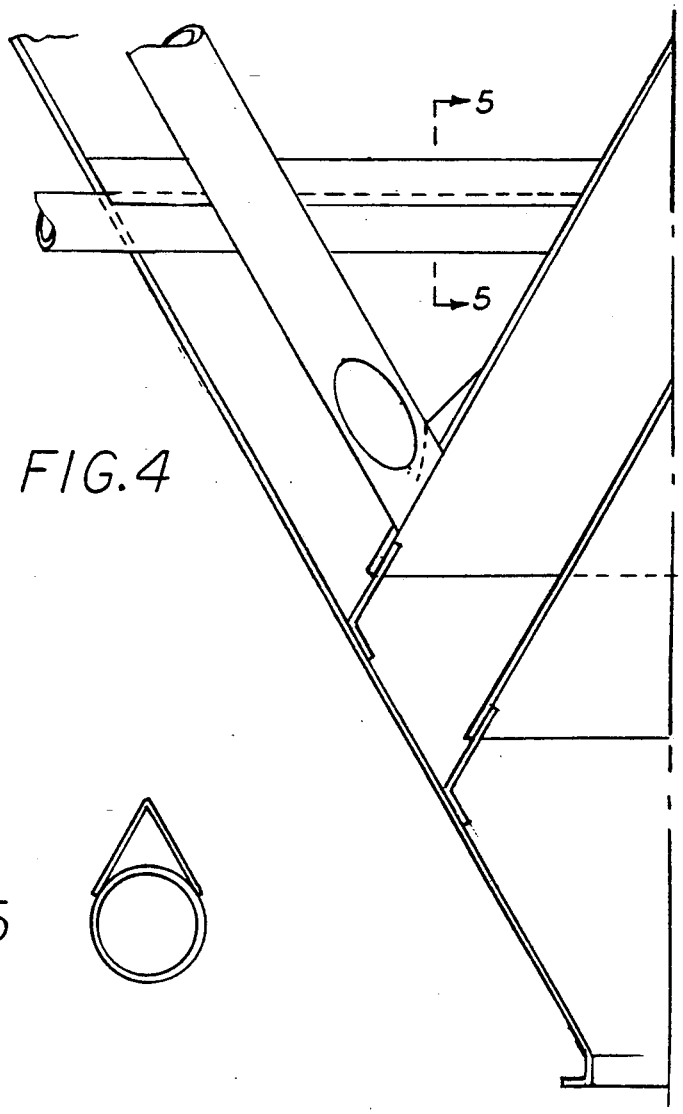
FIG.4
FIG.5

BLENDER FOR PARTICULATE MATERIALS

FIELD OF THE INVENTION

My invention relates to blenders and more particularly to method and apparatus for thoroughly blending particulate or granular materials with the recirculation required limited to the time in which the hopper is filled. A test apparatus for confirming the parameters of the design for optimum efficiency in blending is the subject of a Divisional Application carved from this Application.

BACKGROUND OF THE INVENTION

Prior to the advent of large scale use of polymers in such applications as continuous film or filament production, the needs of industry for precision blending of bulk solids products were met with mechanical tumbler, ribbon or screw blenders. Capacities of these units ranged from one cubic foot to over 1,000 cubic feet.

As the demand for plastics grew, it became apparent that much larger blender volumes were necessary to allow continuous production lines in plastics users' plants to operate without frequent shutdowns caused either by (1) variations in physical properties or (2) additive content inherent in the producer's production processes. This led to a demand for tumble blenders in the nominal 6000 cubic foot capacity range.

The high cost of large tumble blender installations prompted industry-wide efforts to develop a blending capability in storage silos to comply with the product uniformity requirements of the polymer industry. A number of designs resulted, some silo blenders having capacities in the 30,000 cubic foot range.

As storage bins or hoppers are filled with granular or particulate material, it often happens that an inhomogeneous distribution of material occurs. There may be several reasons for this result. In the first place, as material flows into a hopper, the material beneath the inlet nozzle piles up at the angle of repose of the material. In this case the larger particles often roll down the peak toward the sides of the hopper, leaving the finer particles in the central region. Inhomogeneity can also occur when the hopper is filled with different batches of the same material because of variations of composition of individual batches. When material is drawn off through an outlet at the bottom of the hopper, the material flows from the region directly above the nozzle. Thus the material will not be representative of the average characteristics of the material in the hopper.

DESCRIPTION OF THE PRIOR ART

Efficient silo blenders are available today in two broad categories:

A. Gravity Blenders

These designs generally use either external or internal tubes having openings to allow solids in the bin to flow from the main silo body to a separate blend chamber below the silo. The tube openings in the main body of the silo are randomly located so that material drained into the blend chamber represents a typical composite of the material in the main silo body.

B. Internally Recirculated Blenders

These units rely on an external source of air to pick up material in the lower part of the silo body by an orifice arrangement, and convey it to the upper part of the main silo. The material flowing vertically down through the silo is randomly sampled by the openings in the tubes and sampled by inverted cones, resulting in homogenization of the silo contents after a period of time.

The performance of both Gravity Blenders and Internally Recirculated Blenders can be significantly improved by recirculation while the blender is being filled.

Prior art attempts at a solution to the segregation problem typically included placing perforated blending tubes vertically within the hopper. Such tubes have openings spaced apart along their axes which allow material from all levels within the hopper to enter the tubes. The lower portion of the blending tubes communicate with the outlet nozzle so that a more nearly homogeneous mixture of the material issues from the outlet of the hopper.

In spite of many efforts to completely blend the particulate material, it is usually necessary in prior art blenders to specially treat the final portion of the discharge, to achieve acceptable results. For example, U.S. Pat. No. 4,923,304, issued on May 9, 1990, discloses that the first and last few pounds are not used, but instead are withdrawn and later remixed with fresh ingredients, and re-poured, with these fresh ingredients, back into the dispensing apparatus.

It is thus a prime objective of this invention to more efficiently blend the material passing through the apparatus, so that, at the least, the final portion of the material of a batch need not be reprocessed therethrough. The test apparatus is designed to simulate, with its adjustable cone positioning, the working blender in proportions, angles, and in performance with the same particulate material.

It is a second objective to eliminate tedious and costly modification of the blender apparatus, after construction, by predetermining the proper parameters with the analogous test apparatus.

Rather than using valves and other mechanical elements to control particulate flow, the particulate material itself serves as a dam external to the blending tubes, when obstruction to flow is required. The dam then dissolves and its material blends with the material from inside the blending tubes as the hopper empties.

Inasmuch as the compressed particulate material, when in its blocking mode, assumes the cross section of a keystone, keystone joist, or voussoir, for at least some arcuate length, architectural terminology seems appropriate for use in describing this improvement over the prior art. Further, since the structure is annular, toroidal, or at least arcuate, it would appear clearly descriptive to those skilled in the art, to refer to the structure as an "annular keystone joist" of particulate material.

SUMMARY OF THE INVENTION

My invention, in combination with a conventional hopper and conventional blending tubes can effectively blend a batch of material. The principle employed, which is also used in the test apparatus, is illustrated in the drawings and described in detail.

My invention does not require a separate blending chamber. It utilizes the tendency of particulate solids, flowing downward through a channel with converging sides, to bridge across the channel, blocking the channel, causing all of the material flowing out of the blender to flow through the blending tubes. Thus my invention assures that all of the material discharged from the blender represents a truly typical composite of the blender contents.

Thus a very useful blender can be constructed which can be installed in silos at a much lower cost than blenders that rely solely on separate blend chambers. The blender will use a number of blending tubes or channels which terminate at the same elevation in an inverted cone. The discharge of material from the blender will then flow preferentially from the blending tubes, with essentially zero flow through the annulus between the inverted cone and the vessel cone. Flow through this annulus, in general, cannot occur until the supply of material coming from the blend tubes is exhausted.

It should be noted that recirculating while filling can adequately treat the material below the annulus, as can be seen from FIGS. 7 and 8.

Further, since the comparative volumes shown in FIG. 9, as 901 and 902 for the particulate materials, can be varied by changes in the relative dimensions of the parts of the apparatus, the final blending can be quite fine indeed.

BRIEF DESCRIPTION OF THE DRAWINGS

FIG. 3 provides a schematic diagram of the hopper, piping and pumps, if required for extremely uniform blending within the gravity blender of the present invention;

FIG. 4 provides a sectional view from the vertical centerline through the exterior wall of the lower portion of the hopper of the present invention, including a detail of a blending tube and a conduit for exhaust gases;

FIG. 5 is a section of the conduit of FIG. 4, illustrating the knife-like device for preventing accumulation of particulate matter on the top surface of the conduit;

DESCRIPTION OF PRESENTLY PREFERRED EMBODIMENT OF THE INVENTION

In providing a more detailed discussion of the presently preferred embodiment of the invention, reference will be first made to components of the blending apparatus from the prior art, insofar as they combine with the new invention for improved and more efficient performance at lower cost.

Secondly, reference will be made to the test apparatus, its equivalence as a model for the construction of the blender of this invention, and description of some tests performed and data obtained.

Figure 1:
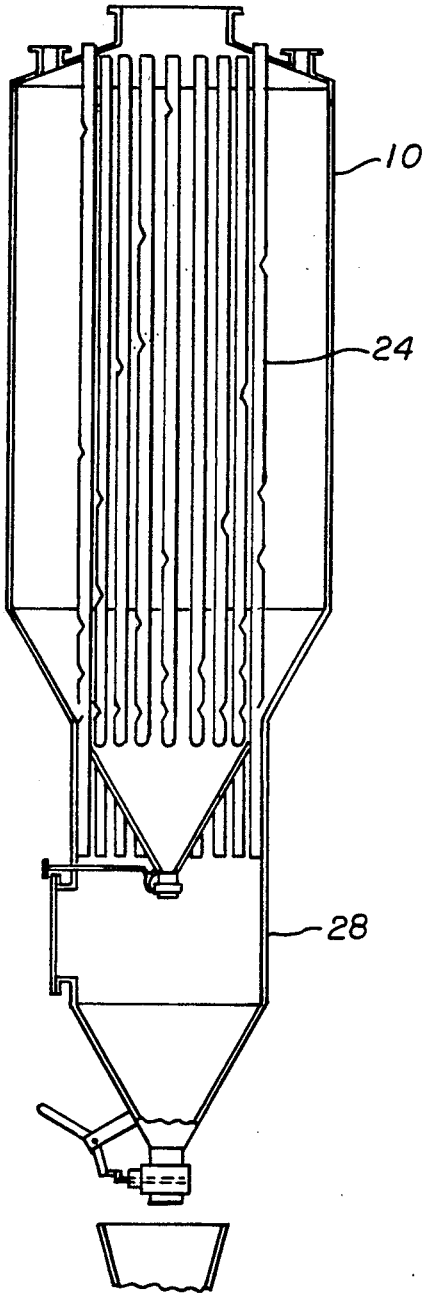
FIG.1 (PRIOR ART)
FIG. 1 provides an elevational, sectional view through the center line of a typical blender of the prior art.

In FIG. 1 is shown a drawing from Pat. No. 3,268,215, issued to T. A. Burton for a Blending Apparatus on Aug. 23, 1966. Illustrated are tank or hopper 10, blending tubes 24, and separate receiver or collector manifold 28. Burton states that: "... mathematical estimates combined with a trial-and-error testing have been found to enable the attainment of extremely accurate uniform mixtures of a plurality of dissimilar materials without the necessity of recirculating the admixed material" (col. 5, lines 34–38).

Figure 2:
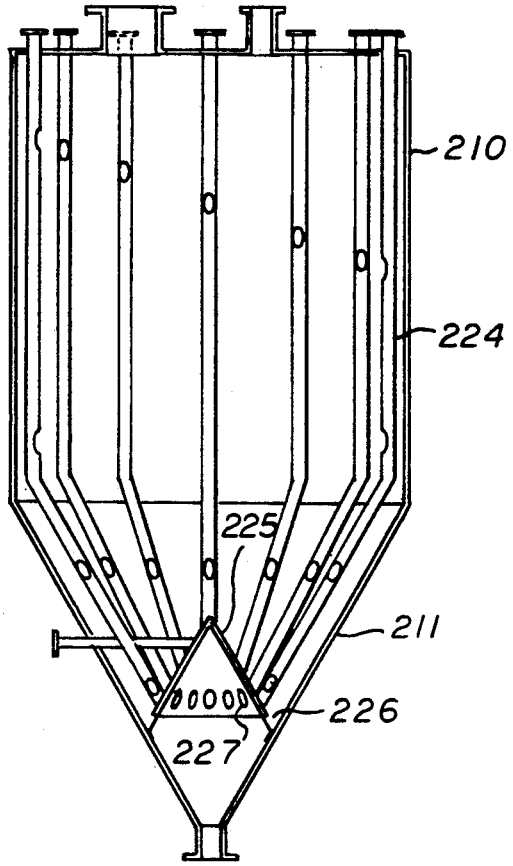
FIG. 2 provides an elevational, sectional view through the center line of a gravity blender of the present invention.

FIG. 2 shows the similarities and the differences between the prior art of FIG. 1 and the present invention. Similarities include a cylindrical housing 210 superimposed upon and sealed to a conical structure 211. Downcomer tubes 224 however, terminate in perforations 227 through the inverted generally horizontal baffle 225, comprising part of the present invention. This means of termination is a significant improvement over the prior art shown in FIG. 1, in which tubes 24 pass entirely through the hopper 10 and terminate in receiver 28. In the annular area 226, between the converging walls of baffle 225 and structure 211, the accumulation of particulate matter forms a toroidal block to the passage of the particulate matter accumulating above the block.

In FIG. 3, recirculating schemes for a portion of the material to be blended are shown in diagrams 302 and 303. In my invention, the improved method is the prompt initiation of the recirculation procedure simultaneously with the loading of material into the blender.

Figure 6:
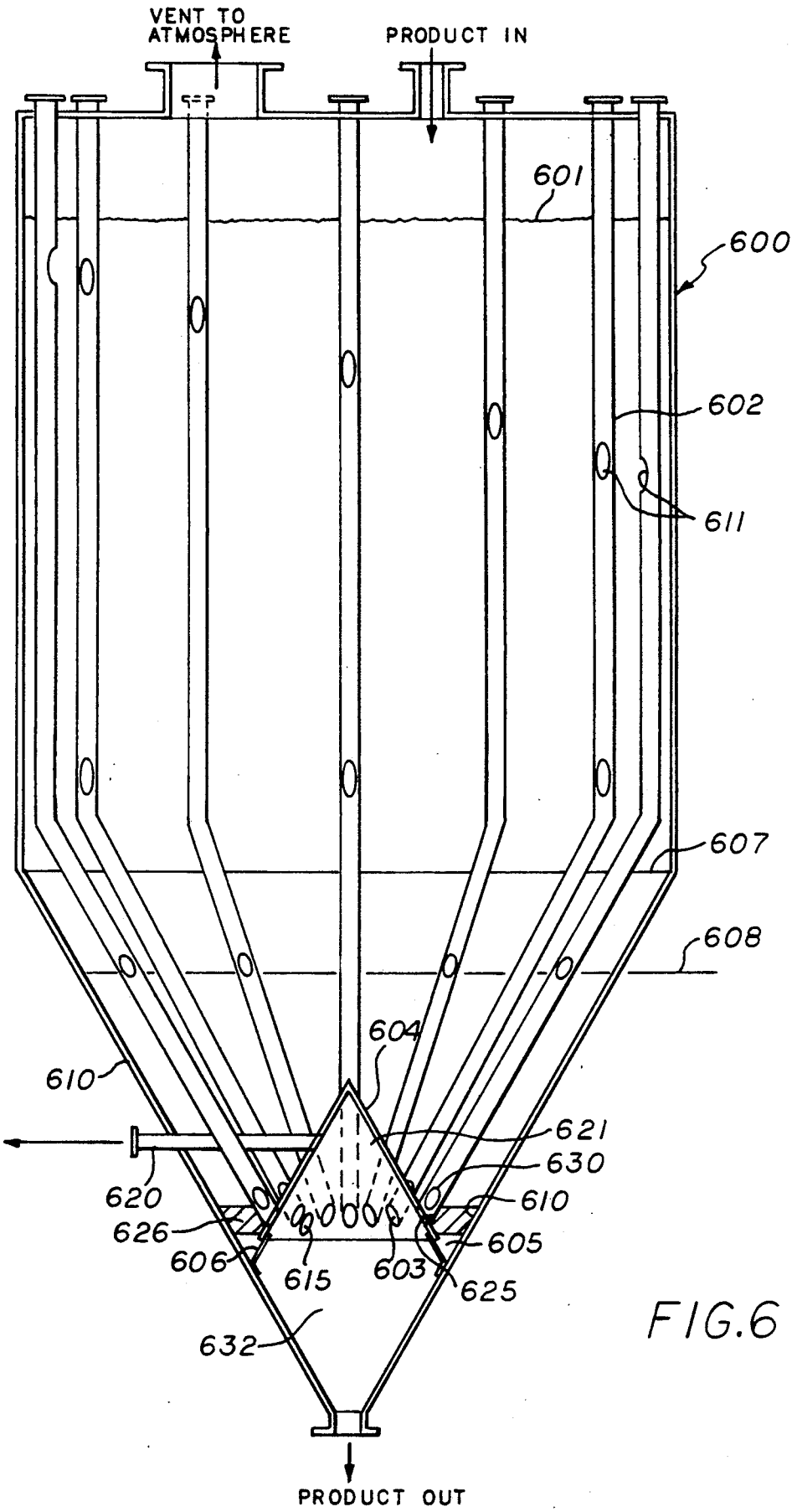
FIG. 6 is a section through the vertical centerline of the present invention as combined with terminations of the conventional blending tubes.

In FIG. 6, the blending tubes, of which tube 602 is an example, terminate in some of the apertures 603. These apertures are formed in the convex surface 604. This means of termination is a significant departure from the prior art, as shown in FIG. 1, in which tubes 24 pass entirely through the hopper 10 and terminate in receiver 28.

The primary inverted cone barrier 604 is supported within and spaced from the downwardly converging bin botton 610 by spaced gussets 606.

A plurality of conduits 602, extend between and connect the bin 600 and the primary inverted convex barrier 604. One or more openings 611 is provided in each of conduits 602 to allow random sampling of the particulate mass 601. Each of the conduits 602 pierce the primary inverted cone barrier 604 to allow the particulate material mass 601 to flow into the mixing zone 632, which has been created by the void under the inverted cone barrier 604. At least one of the lower openings 615 in the primary cone barrier 604 will not communicate with a conduit 602 in order to allow it to sample the particulate material mass 601 at the lowest possible elevation.

A venting means 620 is sometimes provided to communicate between the void 621 and the atmosphere.

Figure 9:
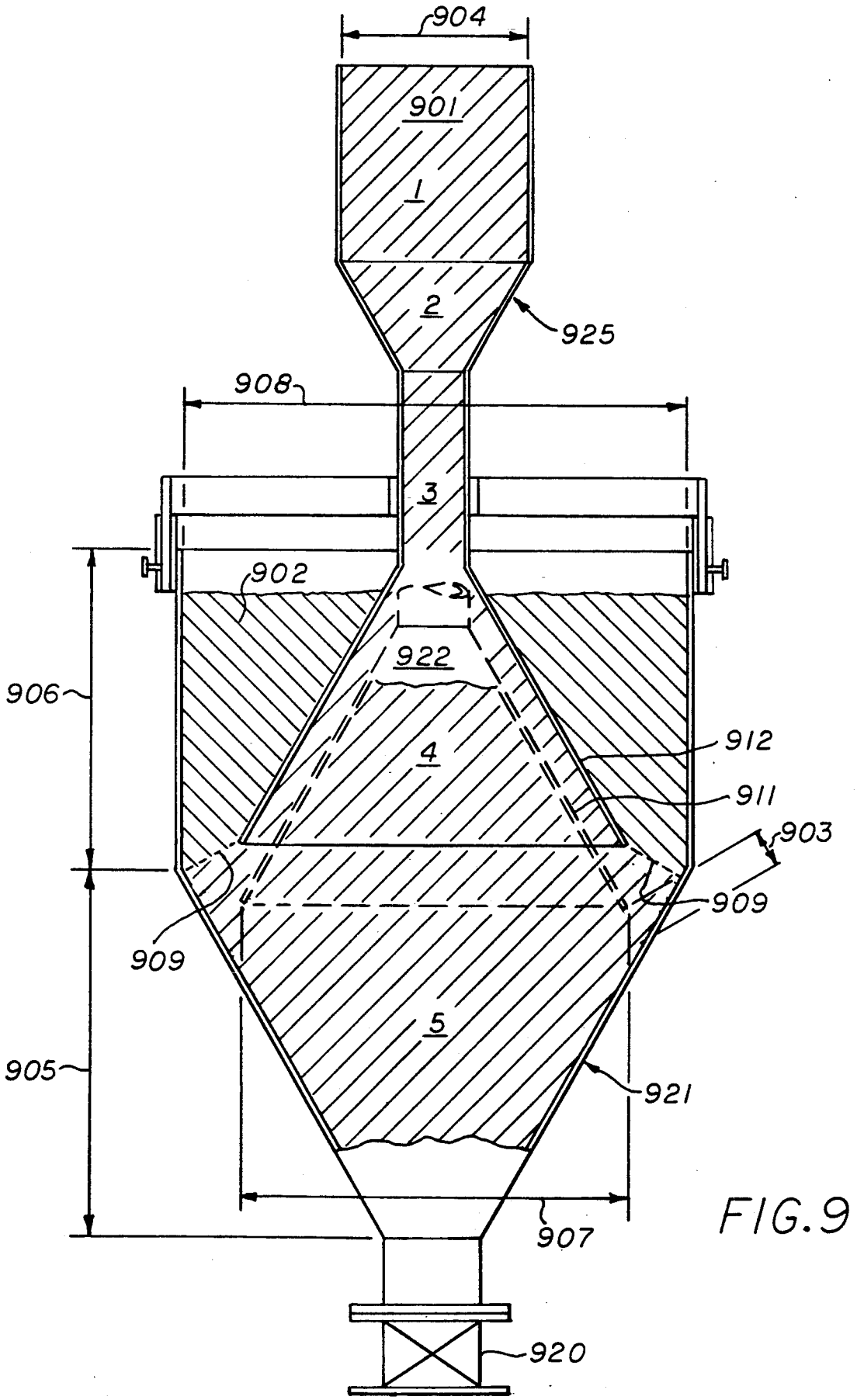
FIG. 9 provides a vertical, sectional view through the center line of the test apparatus, which substantially duplicates the conditions within, and operations of blending of the present invention.
Figure 10:
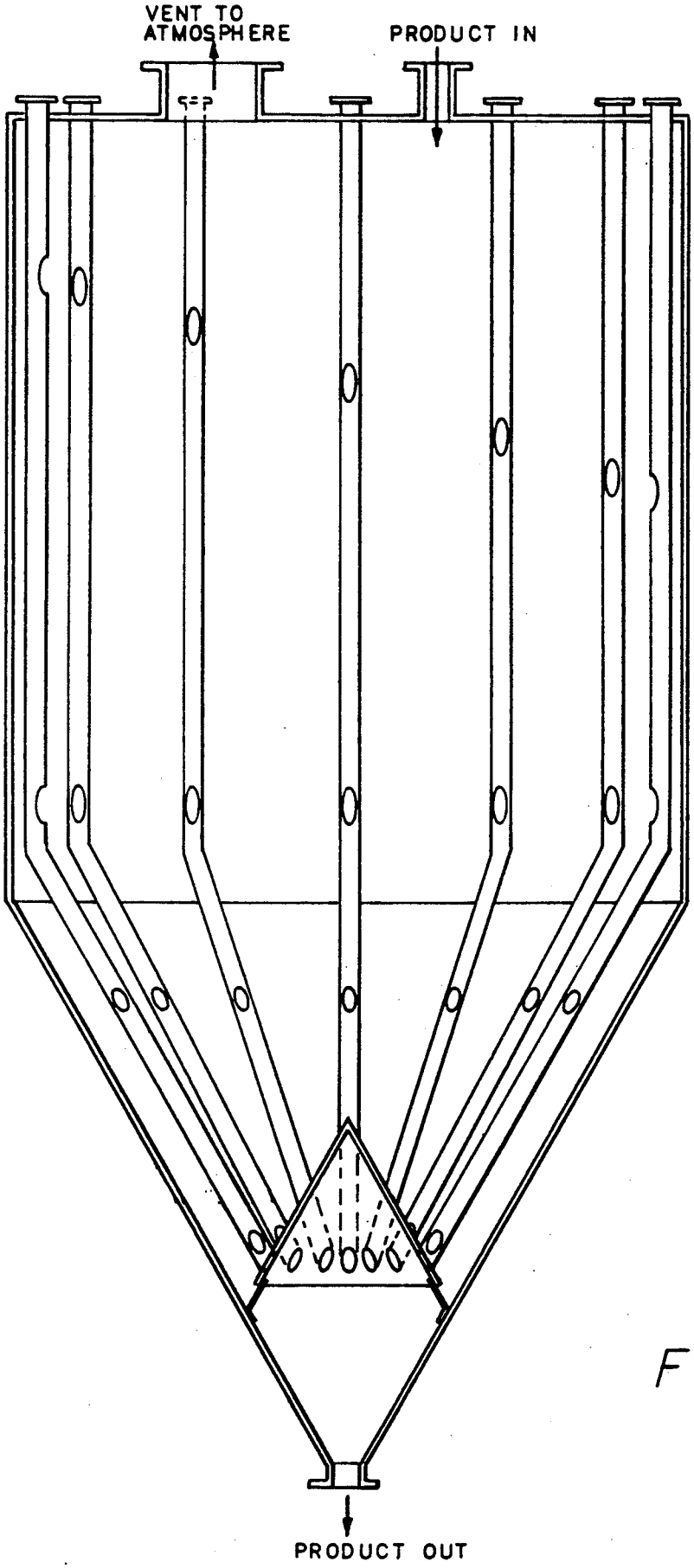
FIG. 10 provides a sectional view from the vertical centerline through the exterior wall of the lower portion of the hopper of the present invention, including a detail of a blending tube, but without a venting conduit for exhaust gases.

It should be noted that convex surface 604 is supported upon brackets 606, and is thus spaced away from the exterior cone 610 by an annular gap shown as 605. It should be noted that adjustments in small blenders, design variations in large blenders in the gap 605 such as shown in FIG. 9 may be incorporated as required. Now, if the surfaces 604, annular gaps 605, and apertures 603, are designed as will be shown in connection with the description of FIG. 9, the material to be blended will begin to fill the hopper 601, but will form a barrier at the annulus 605, past which barrier the particulate material will not descend.

As the blending operation being performed on the batch, or mixture, draws to a close, the level of the material will fall below the seam line 607, and then past a series of apertures 608. The discharge of material from the blender will then flow preferentially from the blending tubes 602, with essentially zero flow through the annulus 605 between the inverted cone and the vessel cone. Flow through this annulus 605 cannot occur until the supply of material coming from the blend tubes 602 is exhausted. The cross section 605 is in effect that of a "keystone joist" and since it is circular, it can be defined as an "annular keystone joist," with surfaces 610 and 604 not necessarily at the same angle, each acting as support.

By variation in the elevations of apertures 608 and 630, and the vertical distance between them, changes in the final blending ratios can be achieved.

The uniform toroidal cross section may be interrupted at intersections with the blending tubes as shown at 625, with the converging channels between the blending tubes serving to support a virtual baffle of particulate material.

Gussets 606 and 706 have been dimensioned proportionally, and in accordance with the gaps 903 or 909 derived in FIG. 9 for inverted cone position 911 or 912. Although adjustability means may be incorporated in gussets 606 and 706 in blenders of modest size, it is assumed that calculation and experimentation with the test apparatus of FIG. 9 will have provided accurate dimensional data for rigid welded gussets in large capacity blenders.

Figure 7:
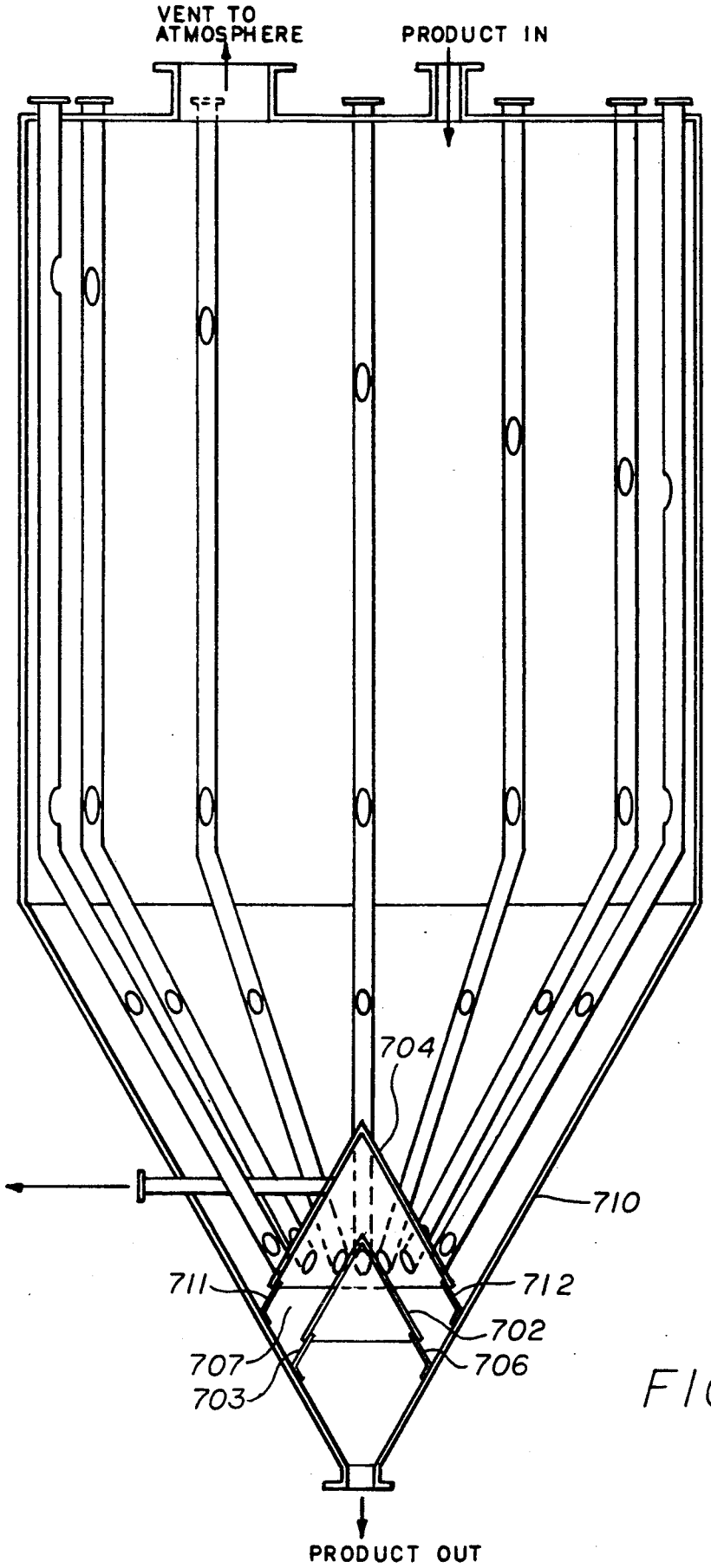
FIG. 7 is a more detailed view of the present invention as combined with two convex surfaces for better blending of virtually all of the material to be blended.
Figure 8:
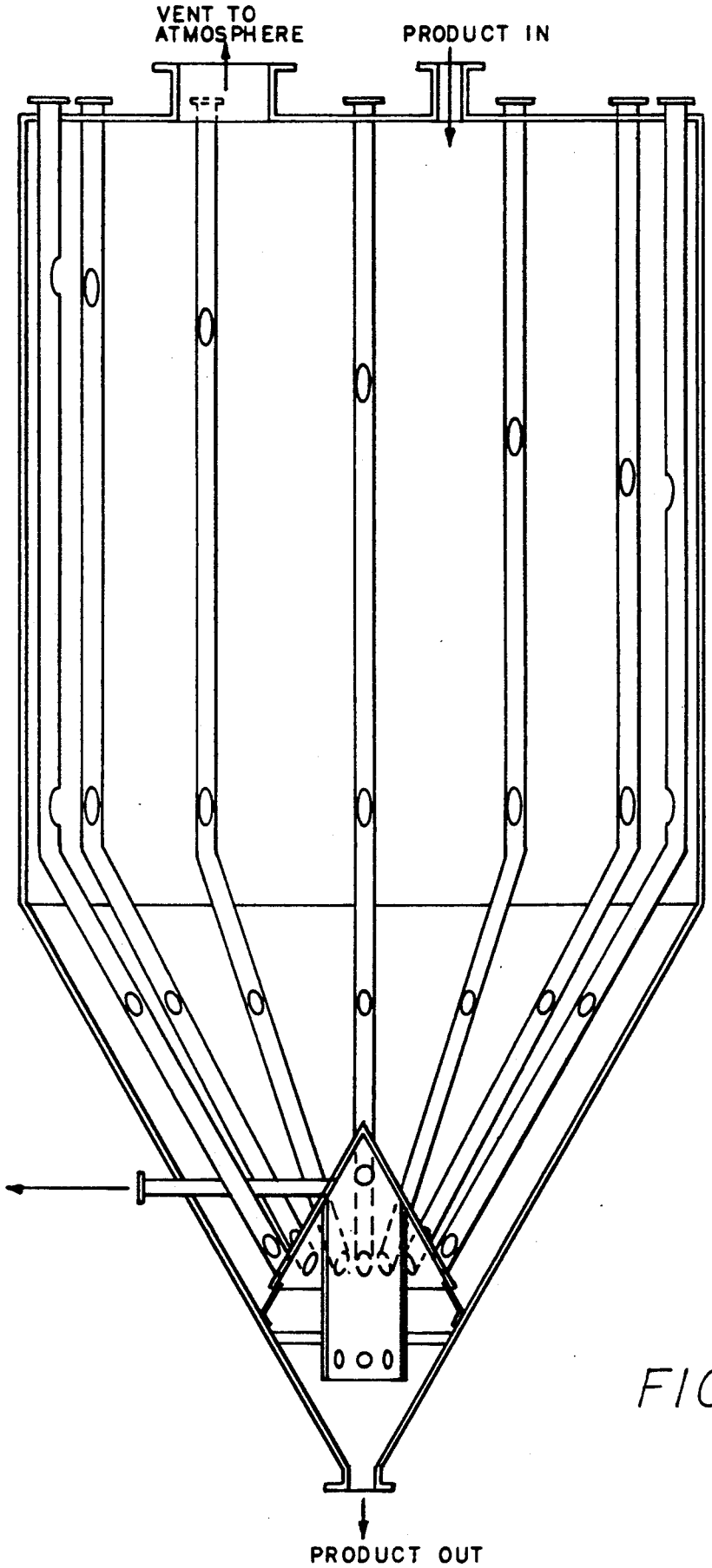
FIG. 8 provides an elevational, sectional view through the center line of a gravity blender of the present invention, in which one basic convex surface is combined with a cylindrical device for further improved blending.

FIGS. 7 and 8 illustrate refinements in the convex interceptor design, each acting to optimize the blending operation.

In FIG. 7, a secondary cone barrier 702 may be positioned in such a manner as to create a second uniform annular clearance. Both the primary inverted cone barrier 704 and the secondary inverted cone barrier 702 are supported within and spaced from the downwardly converging bin bottom 710 by spaced gussets 711, 712 and 703, 706 respectively.

FIG. 9 is a diagram of the Test Apparatus containing material 901, cross hatched for clarity. Material 902 is shown cross hatched at another angle. The inverted cone is set in a position 911 and provides a smaller annular gap 903 than were it raised to a higher position, say 912.

FIG. 9 is a diagram of the Test Apparatus containing material 901, cross hatched for clarity. One such material may be white ⅛-inch round hot cut polyethylene pellets, having a 35 lb./cu.ft. bulk density. Material 902 may be identical in material and dimensions, but black in color.

Material 902 is shown crosshatched at another angle. The inverted cone 922 is set in a position 911 and provides a smaller annular gap 903 than were it raised to a higher position, say 912.

Suitable dimensions for an experimental test apparatus could be: diameter of standpipe 904 about 6 inches; major diameter of bin 908 about 16 inches; height of cylinder and inverted cone 906 about 9 inches; height 905 of lower truncated cone 921 is about 12 inches; diameter 907 of open end of inverted cone 922 is about 12 inches; annular gap 903 may be adjusted to about 1⅛ inches.

One useful test procedure may be performed as follows:

(1) Adjust the annulus 903 so that the distance measured along the surface of the inverted cone to the vessel cone is your best judgement from, say, 1⅛ inches to 3½ inches. We had good results over this entire range, and feel that much more is possible with further experimentation.

(2) Confirm that the vessel and the inverted cone 922 are level.

(3) With the 3-inch Butterfly Valve 920 closed, fill the inverted cone 922 and cone 921 through the standpipe 925, with Material 901 (white pellets) at the start of test, filling volumes shown as circled 1, 2, 3, 4 and 5.

Material 902 may be then put in to fill the remainder of the vessel and will fill to the annular surface 909, in "keystone fashion."

(4) Open the butterfly valve 920, controlling the flow and manually filling the standpipe 925 so there is always material 901 in the standpipe 925. In one test, 41 pounds of white material 901 were run through in this manner with no evidence of any black pellets crossing the "annular keystone joist" 903. The level of black pellet material 902 remained the same during the test up to this point.

(5) In the foregoing test, the vessel was then emptied to determine the quantity of black pellets 902 that would be removed before the white pellet 901 material would be visible in the keystone 903 under cone 922. After 20 pounds of black material 901 was discharged, the remaining white material, when inspected through the empty vessel, had been exposed, showing the annular keystone self-supporting effect. The transition from black to white was complete after discharge of an additional 10 pounds.

Material 902 will not flow out of the vessel until the supply of Material 901 is exhausted. In order to make this principle work:

a. The flow of material from the center nozzle must be regulated by valve 920 to a rate below that would cause voids to form in material 901.

b. Flow properties of material 901 and 902 should be similar. Calculations:

Tabulated Avery Data:

| | | |
|---|---|---|
| (1) | $(6)^2 (0.7854)(6) =$ | approx. 170 in. $^3$ |
| (2) | $(6)^2/3 (.7854)(5.25) =$ | approx 50 in. $^3$ |
| (3) | $(6)^2 (.7854)(3.5) =$ | approx 99 in. $^3$ |
| (4) | $(12)^2/3 (.7854)(10.5) =$ | approx 396 in. $^3$ |

superscripts in error

-continued

| Tabulated Avery Data: | |
|---|---|
| (5) | |
| (14)2/3 (.7854)(12.2) = | approx 626 in. 3 |
| Total Volume = 1341 in. 3 | Weight = 35#/ft. 3 × 1341 in 3 |
| | 1728 in. 3/c.f. |

Conclusions: 27 lbs. was our calculated value.

Note that the forty one pounds of white material that was passed through the standpipe and inverted cone was equal to approximately 1.5 times the initial volume. The top hole principle is sound as demonstrated by this apparatus.

What I claim is:

1. A gravity blender apparatus, having:

in its upper portion, bin means operable to receive and store a mass of particulate material;

a generally horizontal baffle, in the form of an upwardly convex-shaped dome-like dish, similar in circumferential shape to the internal circumference of said bin means and smaller by the width of a preselected annular gap between said bin and said baffle, said baffle having a plurality of perforations adjacent the base of said convex shaped domelike dish, said baffle serving as a nominal divider between said upper portion and the lower portion of said bin;

a plurality of blending conduits extending downward from top of said bin means, said conduits terminating in at least some of said perforations in said baffle, said conduits operable to convey particulate material from said mass toward said lower portion of said bin means; and said annulus serving as voussoir to support a keystone-joist-like mass of particulate material until said blending tubes and said open perforations have released final portions of said particulate matter through said blending tubes and through said perforated apertures into said lower portion of said bin.

2. A gravity blender apparatus, of the type recited in claim 1, having blending zone means disposed generally within said lower portion of said bin means.

3. A gravity blender apparatus, of the type recited in claim 1, in which said annulus is generally circular.

* * * * *